United States Patent [19]

Weiland

[11] 4,042,270

[45] Aug. 16, 1977

[54] POST HOLE DIGGER

[76] Inventor: Edward E. Weiland, 8768 Buffalo, Union Lake, Mich. 48085

[21] Appl. No.: 677,250

[22] Filed: Apr. 15, 1976

[51] Int. Cl.[2] ..... A01B 1/16

[52] U.S. Cl. ..... 294/50.8; 294/118

[58] Field of Search ..... 294/50.5, 50.6, 50.7, 294/50.8, 118, 16, 53.5

[56] References Cited

U.S. PATENT DOCUMENTS

| | | | |
|---|---|---|---|
| 397,383 | 2/1889 | Nivison | 294/50.8 |
| 1,189,107 | 6/1916 | Hescock | 294/118 |
| 2,735,712 | 2/1956 | Hart | 294/50.5 |
| 3,879,079 | 4/1975 | Nicholas | 294/118 |

FOREIGN PATENT DOCUMENTS

| | | | |
|---|---|---|---|
| 578,599 | 9/1924 | France | 99/50.8 |

*Primary Examiner*—James B. Marbert

*Attorney, Agent, or Firm*—Joseph D. Odenweller

[57] ABSTRACT

A post hole digger comprising arm members having a spade end and a handle end with a scissor-type connection proximate their spade end and a bend proximate their handle end such that the central portion of the arms are on opposite sides from their spade ends while the handle ends are on the same side as their spade ends, thus enabling the digging of deeper holes without having the arm members bind at the hole opening.

4 Claims, 3 Drawing Figures

POST HOLE DIGGER

BACKGROUND

Known post hole diggers are of the auger type or spade type. The conventional spade-type digger has two arm members each having a spade at one end and are pivotably connected proximate their spade end. This connection is such that each arm member remains on the same side of the longitudinal axis as its spade end. The digger is driven into the earth and the arm members pulled apart to cause the spade members to close and take a bite of dirt. This works very well in shallow holes but in deeper holes the arm members bind at the top of the hole when they are pulled apart, thus limiting their working depth.

SUMMARY

According to the present invention, there is provided a post hole digger of the spade type which has a much deeper working depth than conventional spade type diggers.

DESCRIPTION OF THE PREFERRED EMBODIMENTS

Figure 1:
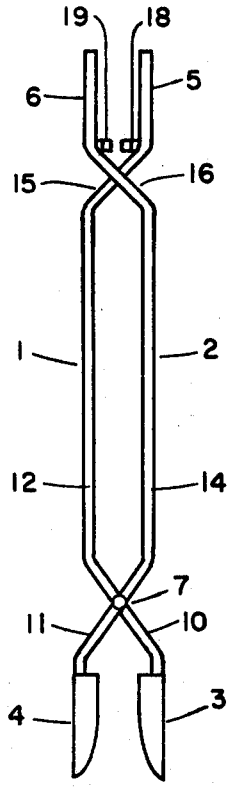
FIG. 1 is a plan view of the post hole digger with the spades in the open position.

Referring to FIG. 1, a pair of arm members 1 and 2 having a spade member 3 and 4 at one end a handle 5 and 6 at the other end are pivotably connected 7, which in the embodiment shown is a bolt inserted through holes in each of the arm members. Connection 7 is of the scissor type such that the spade ends 10 and 11 of arm members 1 and 2 criss-cross each other such that spade member 3 is on the opposite side of the longitudinal axis of the digger from the central segment 12 of arm 1. Likewise, spade member 4 is on the opposite side of the longitudinal axis from the central segment 14 of arm 2.

Arm members 1 and 2 are angularly off-set at a location 15 and 16 proimate to handle end 5 and 6 such that they again criss-cross to place handle end 5 on the same side of the longitudinal axis of spade end 3. Likewise, handle end 6 is on the same side of the longitudinal axis as spade end 4. Extensions 18 and 19 are provided as stop means to prevent handles 5 and 6 from coming together close enough to pinch the operator's fingers.

Figure 2:
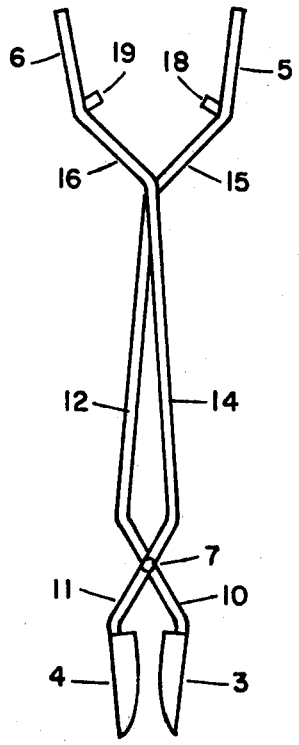
FIG. 2 is a view of the post hole digger with the spades in the closed position.

In operation, the operator grasps the digger by handles 5 and 6 squeezing them together. Through scissor pivot 7 this opens spades 3 and 4 such that they are approximately parallel, as shown in FIG. 1. The spade ends are then thrust into the earth. The operator then spreads handles 5 and 6 which through scissor pivot 7 cause spade members 3 and 4 to bite the earth, as shown in FIG. 2. This bite is withdrawn. This operation is continuously repeated until the hole is of the required depth.

The advantage of the present digger is apparent from FIG. 2. When handles 5 and 6 are spread to bite out a portion of earth, the central segments 12 and 14 come together rather than spreading apart. In this manner the arm members do not bind against the top opening of the hole even when the hole becomes quite deep.

Figure 3:
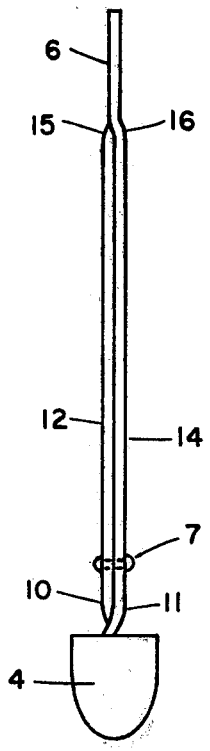
FIG. 3 is a side view of the post hole digger as viewed from the left side of FIG. 1.

Some further construction refinements are shown in FIG. 3. The spade ends 10 and 11 of arms 1 and 2 are off-set so they fall on the same axis such that spade members 3 and 4 are directly opposed. Likewise, arm members 1 and 2 are off-set at 15 and 16 such that handles 5 and 6 are directly opposite. This makes for ease of operation.

Various modifications of the disclosed structure can be made without departing from the essence of the invention, which is the use of scissor-type pivoting arm members such that when the spades are closed to take a bite of earth the arms come together through their central portion rather than spreading apart as in conventional spade-type hole diggers.

I claim:

1. A post hole digger adapted for digging deep holes comprising a pair of arm members each having a spade end, a central segment and a handle end, each of said arm members having spade means connected at said spade end, said spade end and said handle end of each of said arm members being on substantially the same longitudinal axis, each of said central segments being offset from the axis through its respective spade end and handle end, each of said central segments being connected to its respective spade end by a lower angle segment and to its respective handle end by an upper angle segment, said arm members being pivotably connected at a location in said lower angle segments, said pivotable connection being of the scissor type such that said central segments of said arm members are on the opposite side of the central longitudinal axis of said digger from their respective spade ends, said central segments being aligned such that when said handle ends are pivoted to their closest approach the upper ends of said central segments are spaced from each other at least about as far apart as their lower ends, said upper angle members crossing each other such that said spade end and said handle end of each of said arm members are on the same side of said central longitudinal axis.

2. A post hole digger of claim 1 having stop means to prevent said handle ends from approaching each other close enough to pinch the operator's fingers.

3. A post hole digger of claim 1 wherein said central segments of said arms are substantially straight and parallel to each other when said handle ends are together.

4. A post hole digger of claim 1 wherein said handle ends are offset towards the plane in which they pivot such that they are opposite each other and in the same plane.

* * * * *